US010151552B2

(12) United States Patent
Heurlin

(10) Patent No.: US 10,151,552 B2
(45) **Date of Patent: *Dec. 11, 2018**

(54) LINE-OF-SIGHT APPARATUS LOCKING ARRANGEMENT

(71) Applicant: SAAB AB, Linköping (SE)

(72) Inventor: Gustav Heurlin, Stockholm (SE)

(73) Assignee: SAAB AB, Linköping (SE)

( * ) Notice: Subject to any disclaimer, the term of this patent is extended or adjusted under 35 U.S.C. 154(b) by 0 days.

This patent is subject to a terminal disclaimer.

(21) Appl. No.: 15/311,308

(22) PCT Filed: May 15, 2014

(86) PCT No.: PCT/SE2014/050591

§ 371 (c)(1),
(2) Date: Nov. 15, 2016

(87) PCT Pub. No.: WO2015/174898

PCT Pub. Date: Nov. 19, 2015

(65) Prior Publication Data

US 2017/0108305 A1 Apr. 20, 2017

(51) Int. Cl.
*F41A 23/00* (2006.01)

(52) U.S. Cl.
CPC ..... *F41A 23/005* (2013.01)

(58) Field of Classification Search
CPC ..... B25B 13/18; B25B 13/22; B25B 1/12; B25B 1/14; F41A 23/00; F41A 23/005
See application file for complete search history.

(56) References Cited

U.S. PATENT DOCUMENTS 2,403,591 A 7/1946 Ewart
2,415,340 A 2/1947 Ardenne et al.
2,582,140 A * 1/1952 Leek ..... F41A 23/16 42/94

(Continued)

FOREIGN PATENT DOCUMENTS

FR 378272 A 9/1907
GB 2504466 A 2/2014

OTHER PUBLICATIONS

PCT/ISA/210—International Search Report—dated Feb. 6, 2015 (Issued in Application No. PCT/SE2014/050591).

(Continued)

*Primary Examiner* — Michael D David
(74) *Attorney, Agent, or Firm* — Venable LLP; Jeffri A. Kaminski

(57) ABSTRACT

The present invention regards a line-of-sight apparatus locking arrangement for demountably securing a line-of-sight apparatus to said arrangement, comprising a locking device for locking the apparatus to the arrangement comprising a handle member adapted for attachment to a rotation mechanism coupled to a translation mechanism adapted for, during maneuver of the locking device, converting rotational motion into translator motion, a pressing portion of the translation mechanism is provided for abutment against an abutment area of the apparatus. The translation mechanism comprising a resilient member provided for urging said pressing portion against the abutment area.

8 Claims, 5 Drawing Sheets

(56) References Cited

U.S. PATENT DOCUMENTS

| | | | | | |
|---|---|---|---|---|---|
| 2,868,080 | A * | 1/1959 | Meyer | F41A 23/005 | 89/37.03 |
| 2,870,683 | A | 1/1959 | Wilson | | |
| 3,055,071 | A | 9/1962 | Dzus et al. | | |
| 4,026,057 | A * | 5/1977 | Cady | F41A 23/16 | 42/94 |
| 4,333,385 | A * | 6/1982 | Culver | F41A 23/16 | 73/167 |
| 4,621,563 | A | 11/1986 | Poiencot | | |
| 4,876,814 | A * | 10/1989 | Lombardo | F41A 23/04 | 42/94 |
| 5,070,636 | A * | 12/1991 | Mueller | F41A 23/16 | 42/94 |
| 5,661,919 | A * | 9/1997 | Pryor | F41A 23/16 | 42/94 |
| 5,933,999 | A * | 8/1999 | McClure | B60R 7/14 | 42/94 |
| 5,937,561 | A | 8/1999 | Abernethy | | |
| 7,356,960 | B1 | 4/2008 | Knitt | | |
| 7,454,858 | B2 * | 11/2008 | Griffin | F41C 23/16 | 42/71.01 |
| 7,823,317 | B2 * | 11/2010 | Potterfield | F41A 23/16 | 248/121 |
| 7,886,474 | B2 * | 2/2011 | Werner | F41A 23/16 | 42/94 |
| 7,954,272 | B2 * | 6/2011 | Potterfield | F41A 23/10 | 248/125.8 |
| 7,963,206 | B2 * | 6/2011 | Bartle | F41A 23/16 | 42/94 |
| 8,006,426 | B1 * | 8/2011 | Carroll | F41A 23/14 | 42/94 |
| 8,621,773 | B2 * | 1/2014 | Morrow | F41A 23/16 | 42/94 |
| 8,931,201 | B2 * | 1/2015 | Gianladis | F41A 23/18 | 42/94 |
| 9,206,941 | B2 * | 12/2015 | Smith | F16M 11/04 | |
| 2007/0251375 | A1 | 11/2007 | Colburn et al. | | |
| 2013/0312307 | A1 | 11/2013 | Rorick | | |
| 2014/0013644 | A1 | 1/2014 | Trapp | | |
| 2017/0108305 | A1 * | 4/2017 | Heurlin | F41A 23/005 | |

OTHER PUBLICATIONS

PCT/IPEA/408—Written Opinion of the International Prelimiarny Examining Authority—dated Apr. 20, 2016—(Issued in Application No. PCT/SE2014/050591).

PCT/IPEA/409—International Preliminary Report on PA Tentability—dated Sep. 5, 2016—(Issued in Application No. PCT/SE2014/050591).

PCT/IPEA/416—Notification of Transmittal of International Preliminary Report on Patentability—dated Sep. 5, 2016—(Issued in Application No. PCT/SE2014/050591).

Extended European Search Report in corresponding European Application No. 14891830.3, dated Dec. 7, 2017 (9 pages).

* cited by examiner

LINE-OF-SIGHT APPARATUS LOCKING ARRANGEMENT

CROSS-REFERENCE TO RELATED APPLICATIONS

This application is a national phase under 35 U.S.C. § 371 of PCT/SE2014/050591, filed May 15, 2014.

TECHNICAL FIELD

The present invention relates to a line-of-sight apparatus locking arrangement according to the preamble of claim 1.

The invention relates to mounting arrangements adapted for mounting of line-of-sight apparatuses, such as machine guns, automatic guns, remote weapon systems, light weight cannons, training sensor equipped devices, tank-mounted coaxial weapons, general purpose machine guns and other line-of-sight apparatuses.

The invention is not limited thereto, but can be used also for arrangements adapted for mounting of a wide range of different types of weapons and sight and/or sensor apparatuses.

BACKGROUND ART

There is a desire to provide a mounting and locking device and arrangement for achieving rapid mount and demount of a general weapon, a coaxial machine gun, TV-cameras, sensors or other apparatuses, to a weapon station or remote controlled weapon platform or others.

Current weapon mounts for quick mounting and demounting of different types of machine guns to corresponding platforms have several drawbacks. For example, these designs do not provide rigid securement to the arrangement. Prior art arrangements also exhibit too much play, which results in inferior accuracy of fire.

Current technology is commonly based on mount arrangement with a securing pin passed through an opening of the gun for securing the gun to the arrangement, as shown for example in U.S. Pat. No. 2,415,340.

U.S. Pat. No. 2,403,591 shows a mount for machine guns. The mounting described in U.S. Pat. No. 2,403,591 is designed for engagement with aperture ears and threaded attaching bores and clamping screws for ready attachment of the gun to the arrangement.

Prior art locking devices also fixate the receiver of the weapon, so that internal stress may occur in the receiver resulting in bolt jam or inferior accuracy of aim or other failure.

There is an object to provide a line-of-sight apparatus locking arrangement, to which an apparatus, such as a weapon or sensor device or others, can be rigidly mounted and secured.

There is an object to achieve accuracy of aim under repetitive fire (or occasional fire) even though the apparatus or machine gun is secured to a platform perimeter or lateral position.

There is an object to provide an arrangement, which in general provides accuracy of fire and wherein the apparatus, or weapon, is rigidly mounted and secured to the arrangement.

There is an object to provide a secure and play-free fixation of the abutment area of the apparatus to the arrangement in an efficient way, also if different tolerances of same variant of apparatuses are present. The abutment area is defined as a section of the apparatus where the arrangement (and/or locking device) is in engagement with the apparatus.

There is an object to provide a line-of-sight apparatus locking arrangement, herein also called arrangement, which can be used for rigidly holding a specific variant (type of gun, sensor etc.) of apparatus, wherein the apparatus not primary being designed for rigidly attachment to a substructure, and wherein such apparatus easy can be mounted and de-mounted to the arrangement. Different types of apparatuses (machine guns etc.) exhibit different interfaces or measures.

There is an object that each time the user mounts the apparatus to the arrangement, the arrangement will hold the apparatus in a position that is similar for each time and corresponds to previous mounting so that the accuracy of aim will satisfying every time.

There is an object to achieve a rigid mount of the apparatus to the arrangement irrespective of different measure due to different wear of different apparatuses of the same type or variant.

There is an object to modernize mount arrangements with purpose to find more reliable and rigid solutions that is less sensitive to vibrations and hits.

There is an object to provide an arrangement, wherein the apparatus can be mounted and demounted to the arrangement in a quick and easy way.

There is an object that the apparatus can be mounted and demounted without any external tools.

There is an object to provide an arrangement, which from educational point of view is easy to handle and use.

SUMMARY OF THE INVENTION

This has been achieved by the line-of-sight apparatus locking arrangement defined in the introduction and being characterized by the features of the characterizing part of claim 1.

In such way is achieved that the apparatus, such as a weapon or sensor device, is rigidly secured to the arrangement. Thereby is promoted a satisfying accuracy of aim under repetitive fire even though the weapon is secured to a platform perimeter or lateral position, i.e. offset center and positioned beside center main gun. Such coaxial weapon position requires extreme tight mount to the platform as moment from recoil also implies the need of high accuracy of aim.

Preferably, the arrangement is adapted for a self-centering functionality of the locking device.

In such way is also achieved that a central weapon station promotes accuracy of aim under repetitive fire after mounting of the apparatus to the arrangement.

Prior art arrangements have too much play, which results in inferior accuracy of fire. The weapon has to be rigidly mounted to the arrangement and in turn the platform, onto which the arrangement is positioned.

In such way is achieved that no internal stress will occur in a longitudinal direction of the apparatus. Prior art locking devices often fixate the receiver of the weapon so that internal stress occurs resulting in bolt jam or inferior accuracy of aim.

Thereby is achieved that the force clamping the apparatus in place always will be present with a desired pre-determined force. The clamping force can thus be constant independent of tolerances and pre-determined from specific needs and type of weapon.

Preferably, the translation mechanism is adapted to convert the rotational motion into a rectilinear motion.

In such way is achieved that the apparatus can be mounted and demounted without any external tools. By means of the apparatus is achieved that the mounting and demounting is easy to understand and from educational aspect also involves efficient handling of the locking device.

Suitably, the translation mechanism is adapted to convert the rotational motion into a curvilinear motion.

In such way is achieved that the apparatus can be mounted and demounted without any external tools. By means of the apparatus is achieved that the mounting and demounting is easy to understand and from educational aspect also involves efficient handling of the locking device.

Preferably, the translation mechanism comprises a screw member.

In such way is achieved a cost-effective production of the arrangement at the same time as the arrangement is reliable in service.

Alternatively, the screw member comprises a plurality of parallel co-working threads. In such way is provided that various clamping forces of the locking device can be achieved by just proper selection of thread entry.

Suitably, a cross through guide member or a catch pin is provided to a screw pin of the screw member. The catch pin ends are guided in elongated slots of a housing encompassing the screw pin, which slots extend in a direction corresponding with the extension of the screw member.

In such way is provided a rigid connection of the screw pin to the arrangement, wherein the threads of the screw member do not solely take up forces acting upon the screw pin, which engages the apparatus abutment area.

Suitably, the translation mechanism comprises a crank member.

In such way is provided a direct translation action from rotational motion to translator motion.

Preferably, the translation mechanism comprises a lever mechanism adapted to clamp the apparatus to the arrangement through the abutment area and locking the apparatus to the arrangement.

Thereby is achieved a clamping force that provides a fixation of the apparatus to the arrangement. The resilient member of the translation mechanism is provided for urging said pressing portion against the abutment area, and strengthening such fixation and securing the abutment.

Suitably, the resilient member comprises at least one disc spring or cup spring.

Alternatively, the resilient member comprises a compression spring member or other resilient member.

Thereby is also achieved that the clamping force, providing fixation of the apparatus to the arrangement, will be constant (or at least approximately constant) irrespective of different measure tolerances of different apparatuses of the same type, within a section of the abutment and locking position (i.e. the section of the apparatus, where the locking device is in engagement with the apparatus) and/or irrespective different measures due to different wear of different apparatuses of the same type.

Thereby is achieved high spring force performance of the resilient member, still achieving a compact resilient member exhibiting a short stroke path.

In such way is achieved that the spring force and stroke length can be modified in an easy way by just adding or removing one or several disc springs to the resilient member comprising the stack of disc springs or disc cups.

Preferably, the spring discs also can be turned to each other so that convex side of one disc spring faces concave side of adjacent disc spring or in other way facing each other dependent upon desired spring characteristic for the arrangement.

In such way is achieved a resilient member that can be stiff and providing high spring force even though the stroke length is relatively long, which length is preferred if the distance between the pressing portion and the apparatus has to be shortened for a certain type of apparatus or machine gun.

In such way is achieved a relatively short time for spring back and each disc spring is likewise compressed to the same amount. Thereby is achieved a constant spring force.

This provides that the locking device pressing portion has time to spring back even between each shot gun, i.e. also when disc springs are in compressed state.

In such way is achieved a locking device that acts with a pressing and locking force clamping upon one unique apparatus abutment area, which locking force will be the same for all apparatuses of one specific type (variant) having a slight different tolerance in measure.

High spring force means that short spring back time can be achieved.

Preferably, the arrangement is adapted with a locking mechanism arranged for locking the handle member in a locked position for preventing rotational motion.

In such way is achieved that unwanted unlocking of the locking device is avoided.

Suitably, the arrangement comprises a receiver front locking device and a receiver rear locking device.

Thereby is achieved that the apparatus can be mounted and demounted to the arrangement in a rapidly way, which is advantageously in case of ambush or regrouping before offensive action. Such a way meaning that a machine gun often is secured in two fastening positions to the arrangement.

Preferably, the front locking device comprises a rectilinear translation mechanism.

In such way can a bore opening of the front part of the receiver be used for mounting, by linear inserting a holding member into the bore opening.

Suitably, the rear locking device comprises a curvilinear translation mechanism.

Thereby is achieved that the curvilinear motion can be used as a motion of a lever mechanism that will move in a direction corresponding with longitudinal center line of the apparatus.

Preferably, the line-of-sight apparatus is an automatic gun.

Suitably, the translation mechanism comprises a resilient member provided for urging said pressing portion against the abutment area.

Thereby is achieved that the force clamping the apparatus in place will always be a desired pre-determined force. The clamping force can thus be constant independent of tolerances.

Suitably, the line-of-sight apparatus is a sensor device.

In such way is achieved that a training system can be used in a similar way as a live combat situation.

In such way is achieved also that a sensor device in a secure and quick way can be mounted to the arrangement.

Preferably, an adjustment screw device is provided for adjusting bias spring of the resilient member and thereby the user can adjust the arrangement from actual type of weapon in an exact manner.

Preferably, the resilient member comprises a pre-pressed compression spring.

Suitably, the resilient member comprises a wave spring.

Preferably, the resilient member comprises a conical compression spring.

Suitably, the resilient member comprises a gas spring.

The object mentioned above is also solved by a weapon station comprising said arrangement according to any of claims 1 to 13.

Thereby is achieved an arrangement of low weight, which is advantageous from handling aspect regarding the arrangement when mounting the latter to a weapon station platform.

BRIEF DESCRIPTION OF THE DRAWINGS

The present invention will now be described by way of examples with references to the accompanying schematic drawings, of which.

DETAILED DESCRIPTION

Hereinafter, embodiments of the present invention will be described in detail with reference to the accompanying drawings, wherein for the sake of clarity and understanding of the invention some details of no importance may be deleted from the drawings.

Figure 1:
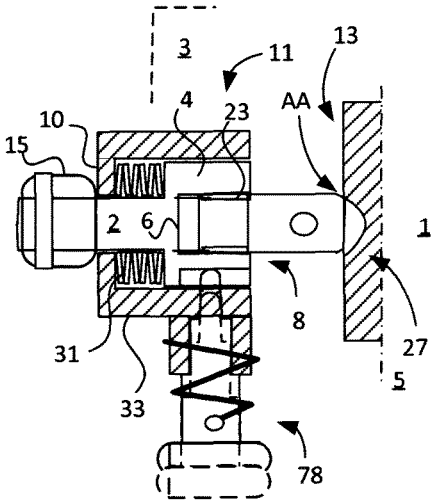
FIG. 1 illustrates a line-of-sight apparatus locking arrangement according to one aspect of the present invention.

FIG. 1 schematically illustrates a line-of-sight apparatus 1 locking arrangement 3 comprising a locking device 11 according to one aspect of the present invention. The FIG. 1 shows the arrangement 3 in a side view. The arrangement 3 comprises the locking device 11 for locking and securing a machine gun 5 (partially shown) to the arrangement 3. The arrangement 3 is thus adapted with a mechanism for demountable securing the machine gun 5. The arrangement 3 comprises a handle 15, which is fixed to a rotation spindle 2. A sleeve 4 having a bottom section 6 is rigidly provided as a part of the rotation spindle 2. The bottom section 6 of the sleeve 4 is fixed to the rotation spindle 2. The rotation spindle 2 and the sleeve 4 are arranged for rotational movement within a housing 33 comprising an open end 8 and a front wall 10. The handle 15 is positioned adjacent the front wall 10. A resilient stack of disc springs 31 being arranged around the rotation spindle 2. The resilient stack is resting partly against the interior of the front wall 10, and partly against outer side of the sleeve bottom section 6, thus arranged in biasing state holding the handle 15 in position towards the front wall 10. A screw 23 is provided with outer thread track in engagement with an internal thread track of the sleeve 4. When a user (not shown) rotates the handle 15, the rotation spindle 2, coupled to the screw 23 via the sleeve 4, will convert the rotational motion into a linear motion (rectilinear) motion. A pressing portion 27 is arranged to the end of the screw 23, which end is provided opposite the handle 15. The pressing portion 27, will during the linear motion, press against an abutment area AA of the apparatus 1. The abutment area AA is a surface of a fastening portion 13 of the apparatus 1. The fastening portion 13 exhibits a width (seen transverse to the longitudinal direction of the apparatus 1) and a length (seen in the longitudinal direction of the apparatus 1). The resilient stack of disc springs 31 will be compressed, when the user rotates the handle 15, and urges the pressing portion 27 against the abutment area AA. The clamping force provides fixation of the machine gun 5 to the arrangement 3. The clamping force will be constant irrespective of different measures in tolerances (e.g. width of the fastening portion of the apparatus) of different apparatuses of the same type. This constant clamping force is thus provided for each individual apparatus, irrespective different measures caused by wear or tolerances (which can vary up to 5 mm for the same type in regard to measures taken across the fastening portion). The arrangement 3 is adapted with a locking mechanism 78 arranged for locking the handle member 15 in a locked position for preventing rotational motion.

Figure 2A:
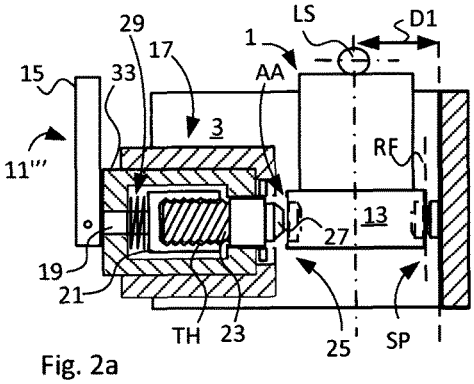
FIGS. 2*a* to 2*d* illustrate a locking arrangement according to one aspect.

FIGS. 2*a* to 2*d* schematically illustrate a locking arrangement 3 according to one aspect. FIG. 2*a* illustrates the arrangement 3 for demountable securing a weapon 1 and the weapon 1 being positioned roughly by a user (not shown) in the locking arrangement 3. The weapon 1 comprises an abutment area AA of a fastening portion 13, which comprises a reference point RF adapted to correlate with the arrangement's 3 line-of-sight LS. The weapon's 1 line-of-sight LS exhibits a predetermined orientation relative the reference point RF of the weapon 1. A supporting point SP of the arrangement 3 is determined to the arrangement's 3 line-of-sight LS. The arrangement 3 is adapted for clamping the weapon 1 rigidly in horizontal and vertical plane. The arrangement 3 comprises a hand grip 15 fixed to a rotation mechanism 17. The rotation mechanism 17 is in the form of an axis 19 rigidly connected to a sleeve 21 having internal thread TH. The internal thread TH is in engagement with a screw 23. The sleeve 21 is thus coupled to a translation mechanism 25 (comprising the screw) and adapted for, during maneuver of the arrangement 3 (as shown in following FIGS. 2*b* to 2*d*), converting rotational motion into translator motion.

The translation motion is in this example straight or a so called rectilinear motion.

Figure 2B:
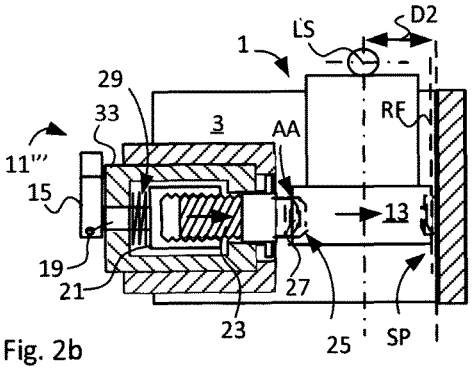

By rotating the hand grip 15, the screw 23 moves towards the abutment area AA of the weapon's 1 fastening portion 13. The translation mechanism 25 comprising the screw 23 comprises a pressing portion 27 provided for abutment against the abutment area AA. In FIG. 2*b* is shown that the hand grip 15 is rotated and the sleeve's 21 rotation moves the screw 23 in rectilinear direction. The pressing portion 27 of the screw 23 will move towards the abutment area AA of the weapon 1. The fastening portion 13 of the weapon 1 is pressed towards the supporting point SP of the arrangement 3 and a distance from weapon's 1 line-of-sight LS to the supporting point SP is defined as D2.

Figure 2C:
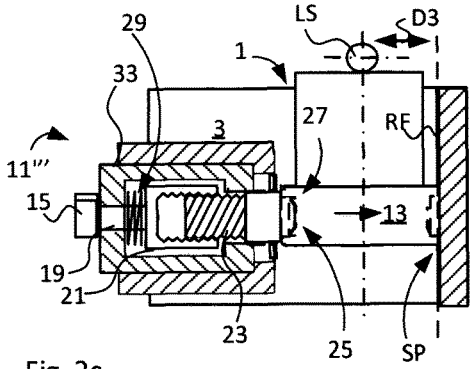
Figure 2D:
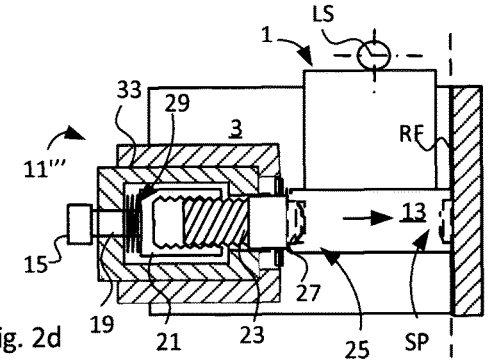

In FIG. 2*c* is shown how the reference point RF of the weapon 1 is in line with the supporting point SP and a distance from the weapon's 1 line-of-sight to LS the supporting point SP is marked with D3. The hand grip 15 has been rotated further by the user and the weapon 1 is clamped in position. The rotation of the hand grip 15 thus urges the pressing portion 27 towards the abutment area AA. A resilient member 29 (in the form of a stack of disc springs) is arranged between the sleeve 21 bottom wall's outer side and a house 33 housing the screw 23 and the sleeve 21. The resilient member 29 will be compressed and urges the pressing portion 27 against the abutment area AA with a constant force. In FIG. 2*d* is shown that the weapon's 1 fastening portion 13 is of larger dimension (wider) than average due to tolerance derivation and as the user rotates the hand grip 15 to the pre-determined end position, as he has been instructed for locking it in that position, the resilient member 29 will be further compressed. But as the compression force is constant, the force holding the weapon's 1 fastening portion 13 will be the same for all weapons (of the same type) having different tolerance measure in view of said dimension.

Figure 3A:
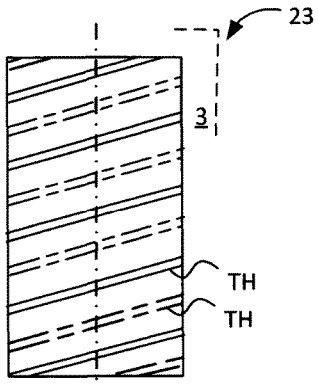
FIGS. 3*a* to 3*b* illustrate a screw member according to one aspect.
Figure 3B:
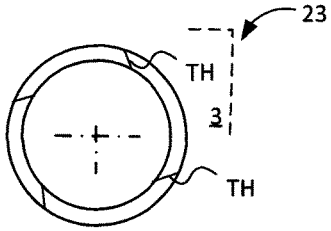

FIGS. 3*a* to 3*b* schematically illustrate a screw 23 of a locking arrangement 3 according to one aspect. FIG. 3*a* shows the screw member 23 in a side view. In this embodiment the screw 23 per se is fixed to a crank (not shown) which is rotatable by a user. The screw 23 is in engagement with a nut shaped member (not shown) which in turn is fixed to a press rod (not shown). When the user rotates the screw 23, the press rod will move linear towards the apparatus 1 fastening portion 13 and clamp the fastening portion 13 (see for example FIG. 2*c*) against a support surface (not shown) of the arrangement 3. In FIG. 3*b* the screw 23 is shown in a direction corresponding with the longitudinal direction of the screw 23. The screw 23 is provided with four threads TH (grooves) running parallel with each other and exhibiting corresponding pitch and the nut shaped member exhibits one protruding thread. This means that four thread TH entrances appear at the end of the screw 23. In such way the user can select multiple entrance angles for the screw 23, and also permitting tightening of the pressure, which acts upon the fastening portion 13 of the weapon. He can thus easy adjust the clamping force of the arrangement 1 depending upon which type of weapon being used.

Figure 4:
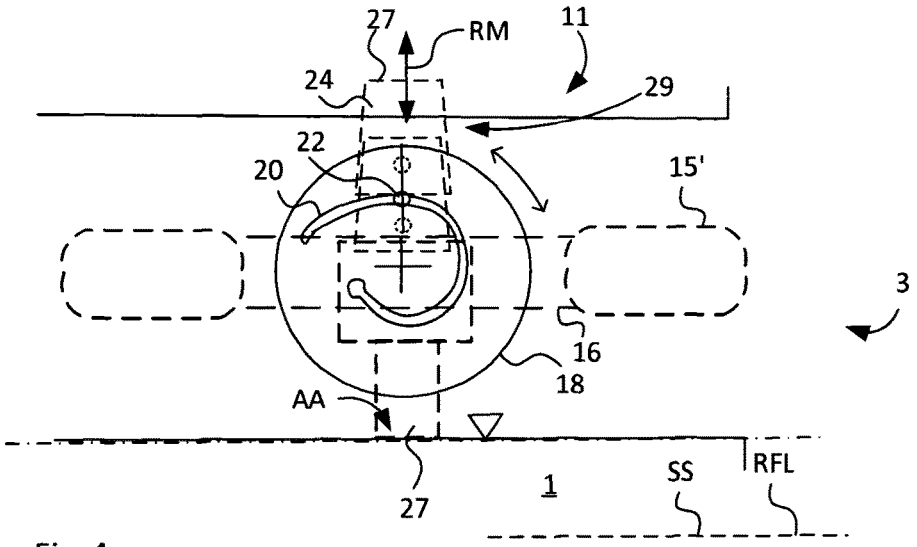
FIG. 4 illustrates a locking device of a line-of-sight apparatus locking arrangement according to one aspect.

FIG. 4 schematically illustrates an arrangement 3 according to one aspect. The arrangement 3 comprising two grip members 15', which are fixed to an arm 16, which in turn comprises a crank motion disc 18 including a helical formed groove 20 in which a pin 22 is arranged to engage for achieving linear motion. The pin 22 is in turn fixed to a stud 24 which is arranged for rectilinear motion RM. The stud 24 comprises a pressing portion 27 provided for abutment against an abutment area AA of the apparatus 1. A resilient member 29 is provided for urging said pressing portion 27 against the abutment area AA, which member 29 provides a constant clamping force, when the grip members 15' are in locked position, regardless various tolerances of the apparatus 1 being mounted. The pressing portion 27 presses the apparatus 1 against a supporting surface SS with a constant pressing force (clamping force). The supporting surface SS corresponds with a reference line RFL.

Figure 5A:
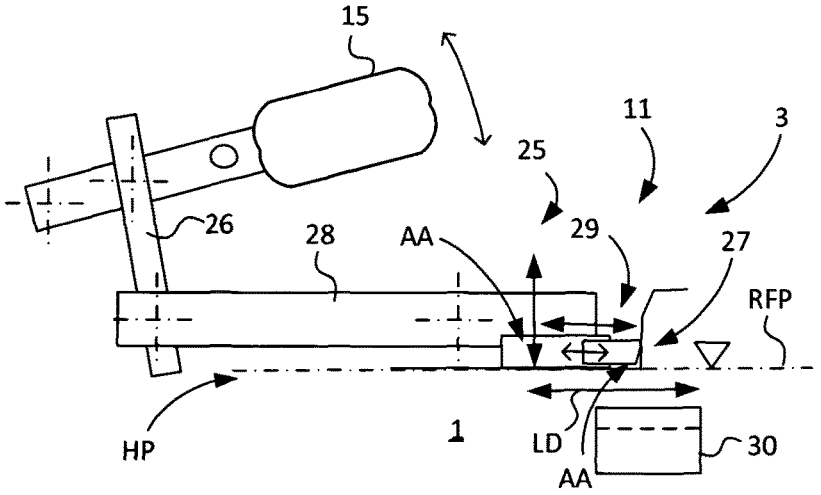
FIGS. 5*a* and 5*b* illustrate a locking device of a line-of-sight apparatus locking arrangement according to one aspect.
Figure 5B:
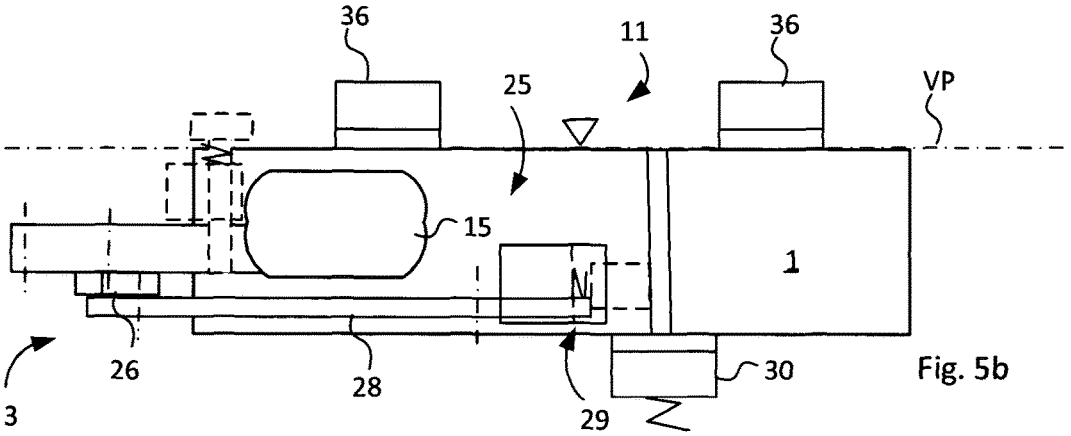

FIGS. 5*a* and 5*b* schematically illustrate a locking arrangement 3 according to one aspect. FIG. 5*a* shows the arrangement 3 in a side view. A handle 15 is pivotally hinged for co-operating with a translation mechanism 25 comprising a push rod 26 acting upon a lever mechanism 28 adapted to clamp the apparatus 1 via the abutment area AA and locking the apparatus 1 to the arrangement 3. A resilient member 29 comprises a conical compression spring (not shown). It is provided for urging a pressing portion 27 of the lever mechanism 28 against the abutment area AA of the apparatus 1. The reference plane RFP is defined as a horizontal plane HP towards which the apparatus 1 is clamped. The apparatus 1 is free to move in longitudinal direction LD. For properly positioning the apparatus 1 relative a vertical reference plane VP (see FIG. 5*b*), a spring loaded shoulder 30 is arranged to urge the apparatus 1 in the horizontal plane HP towards supports 36. See also FIG. 5*b* illustrating the locking device 11 from above. The shoulder 30 adjusts the apparatus 1 in horizontal plane HP towards the vertical reference plane VP and the lever 28 clamps the apparatus 1 against the horizontal plane (reference plane RFP).

Figure 6A:
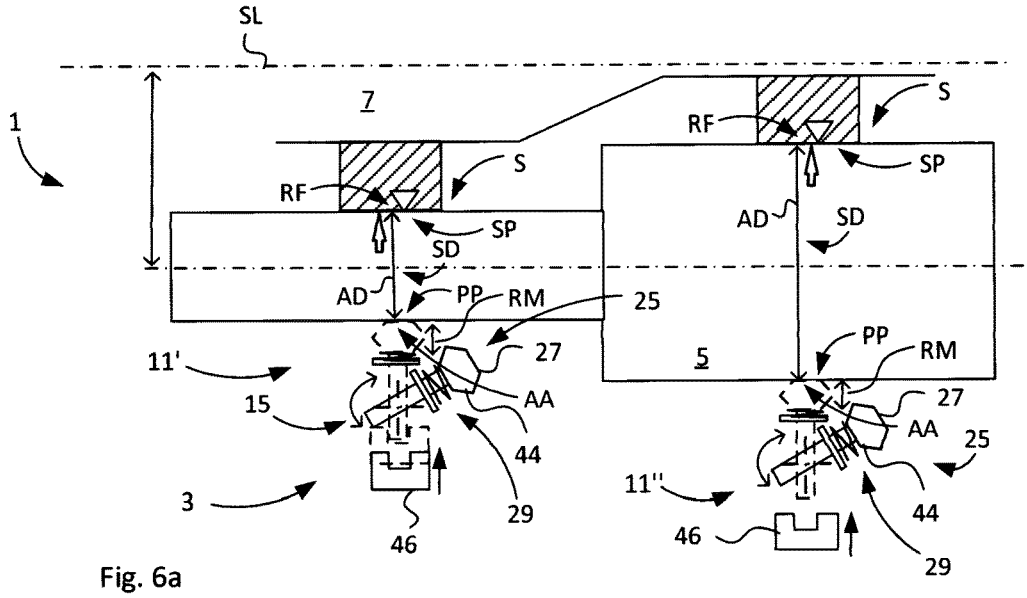
FIGS. 6*a* and 6*b* illustrate a locking arrangement according to one aspect of the present invention.
Figure 6B:
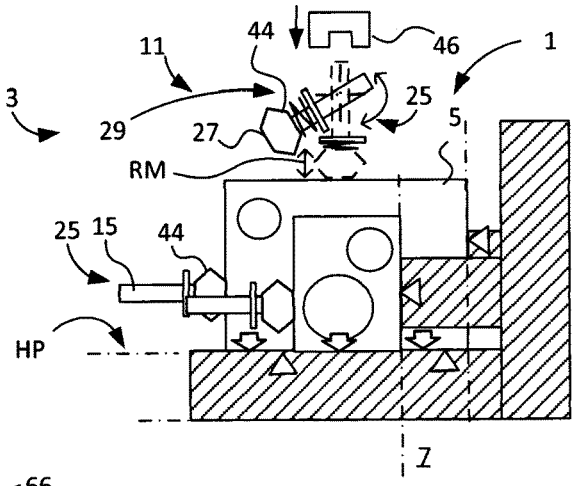

FIGS. 6*a* and 6*b* schematically illustrate a locking arrangement 3 according to one aspect of the present invention. The locking arrangement 3 comprises a front and a rear locking device 11', 11". The arrangement 3 is fixed to a weapon station 7. A machine gun 5 is mounted to the arrangement 3. A translation mechanism 25 is adapted to convert rotational locking motion into a rectilinear motion RM of a clamping head 44. After positioning the clamping head 44 in proper position, a securing slide 46 is moved in securing position for securing a handle 15 of respective locking device 11", 11". The translation mechanism 25 comprises a resilient member 29 provided for urging respective pressing portion 27 against respective abutment area AA of the apparatus 1. For each locking device 11', 11" is provided; a first apparatus 1 distance AD taken from a pressing portion point PP to a reference point RF of the machine gun 5 corresponds to a second distance SD taken from the abutment area AA to a supporting point SP of the arrangement 3. The resilient member 29 acts upon the abutment area AA via the pressing portion 27, wherein the reference point RF of the machine gun 5 will rest against the supporting point SP of the arrangement 3 and the first apparatus distance AD will always be the same as the second distance SD. The position of the pressing portion point PP is achieved by the resilient member 29 translating the pressing portion 27 in a direction towards the supporting point SP of the arrangement 3. In such way the measure between abutment area AA and reference point RF of the machine gun 5 corresponds to the measure taken between pressing portion point PP and the supporting point SP. This implies that even if wear (and/or high range of tolerance variation) of a set of machine guns 5 of the same type (meaning that each individual machine gun 5 exhibits a dimension different from others within section S), the first distance AD always is the same as the second distance SD. Thereby the reference point RF will always correspond to the supporting point SP of the arrangement 3. The supporting point SP of the arrangement 3 is in turn defined in relation to the weapon station sight line SL. The clamping force is also adjustable to be constant for different dimensions in section S. In FIG. 6*b* the arrangement 3 is shown in a front view. An upper locking device 11 of the arrangement 3 is adapted to clamp the machine gun 5 towards the horizontal plane HP.

Figure 7B:
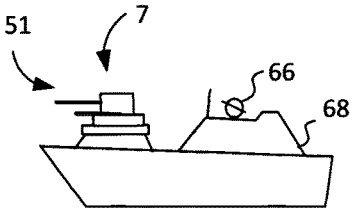
FIGS. 7*a* and 7*b* illustrate a co-axial weapon comprising a locking arrangement according to one aspect.
Figure 7A:
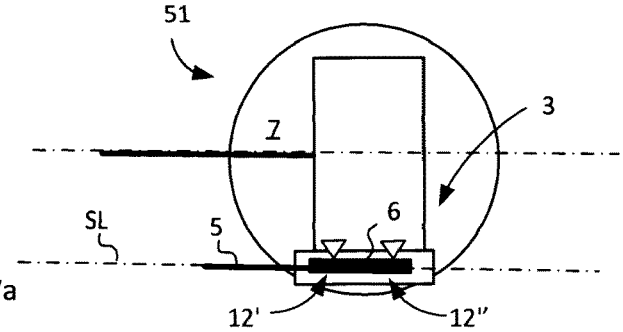

FIGS. 7*a* and 7*b* schematically illustrate a co-axial weapon 51 comprising an arrangement 3 according to one aspect of the present invention. FIG. 7*a* shows the arrangement 3 with mounted machine gun 5. The machine gun 5 comprises a receiver 6. A front locking device is a receiver front part locking device 12' and a rear locking device is a receiver rear part locking device 12". According to one aspect of the invention the machine gun 5 is easy and quickly mounted by a user 66 to the co-axial weapon 51 and the arrangement 3 in such way that the sight line SL of the machine gun 5 corresponds to the pre-determined sight line. Due to the arrangement 3 according to one aspect, the machine gun 5 sight line SL will always be the same each time the user 66 mounts the machine gun 5 to the arrangement 3. FIG. 7*b* shows the co-axial weapon 51 used in a weapon station of a combat vessel 68. The machine gun 5 is remotely controlled the user 66.

Figure 8D:
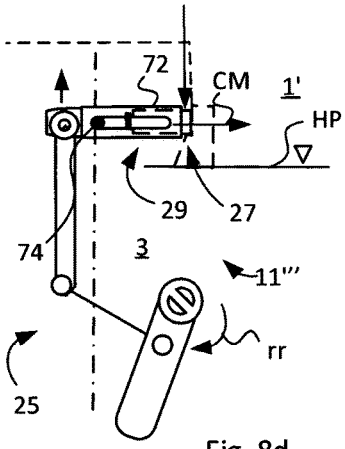
FIGS. 8*a* to 8*d* illustrate an arrangement according to one aspect.
Figure 8C:
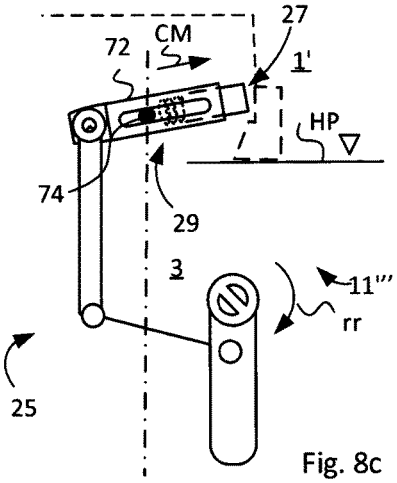
Figure 8B:
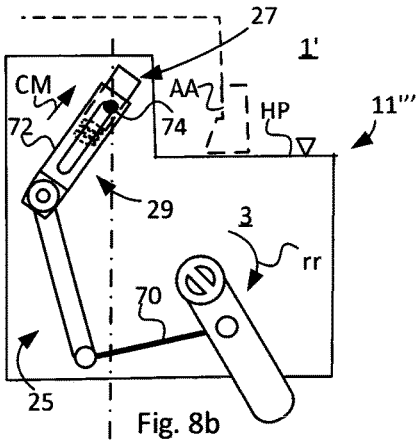
Figure 8A:
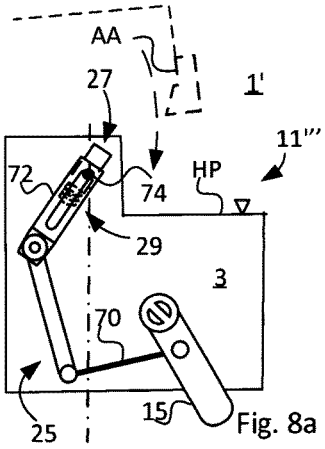

FIGS. 8*a* to 8*d* illustrate an arrangement 3 according to one aspect. The arrangement 3 is arranged to hold a sensor device 1' used in combat training and simulation practice. FIG. 8*a* shows that the sensor device 1' is moved into position roughly onto the arrangement 3. FIGS. 8*b* to 8*d* show that during maneuver of the arrangement 3, a rotational motion rr being converted into translator motion in the form of curvilinear (curved) motion CM of a pressing portion 27 of a locking device 11". A translation mechanism 25 comprises the pressing portion 27 provided for abutment against an abutment area AA of the sensor device 1'. The translation mechanism 25 comprises a resilient member 29 provided for urging the pressing portion 27 of the locking device 11'" towards the abutment area AA of the sensor device 1'. A crank arm 70 of the translation mechanism 25 provides movement of a lever arm 72 hinged over a crank motion pin 74 in motion downwards and backwards so that the pressing portion 27 of the locking device 11'" properly will come into clamping position for urging the sensor device 1' towards a horizontal plane HP. The sensor device 1' (by the insertion of the sensor device into the arrangement) will abut a vertical plane by means of a pair of spring loaded lips (not shown).

FIGS. 9*a* to 9*d* schematically illustrate a resilient member 29 comprising conical spring washers 31' of an arrangement 3 according to one aspect of the present invention. The resilient member 29 is adapted for clamping or holding a gun (not shown) to the arrangement 3 with a constant predetermined clamping force.

Figure 9A:
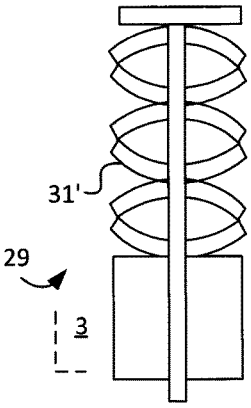
FIGS. 9*a* to 9*d* illustrate a resilient member comprising conical spring washers of a locking arrangement according to one aspect of the present invention.
Figure 9B:
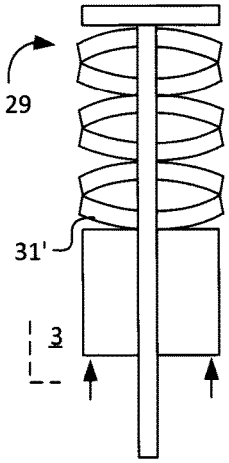
Figure 9C:
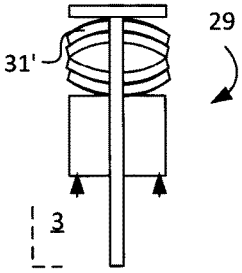
Figure 9D:
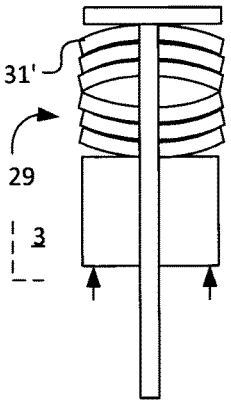

According to one aspect, the resilient member 29 comprises six conical spring washers 31' as shown in FIGS. 9*a* and 9*b*. In FIG. 9*a* is shown unloaded state and FIG. 9*b* shows the loaded state. Even in case the resilient member 29 further being compressed caused by tolerance variation, the clamping force of the arrangement 3 still will be the same. In case the user wants to adapt the arrangement 3 to a larger dimension of the fastening portion of the gun, he simply removes (as shown in FIG. 9*c*) a pair of spring washers 31'. In case the user wants to change other characteristics of the resilient member 29, he simply turns upside down selected spring washers 31' (as shown in FIG. 9*d*) for providing a stiffer mounting to the arrangement 3.

Figure 10:
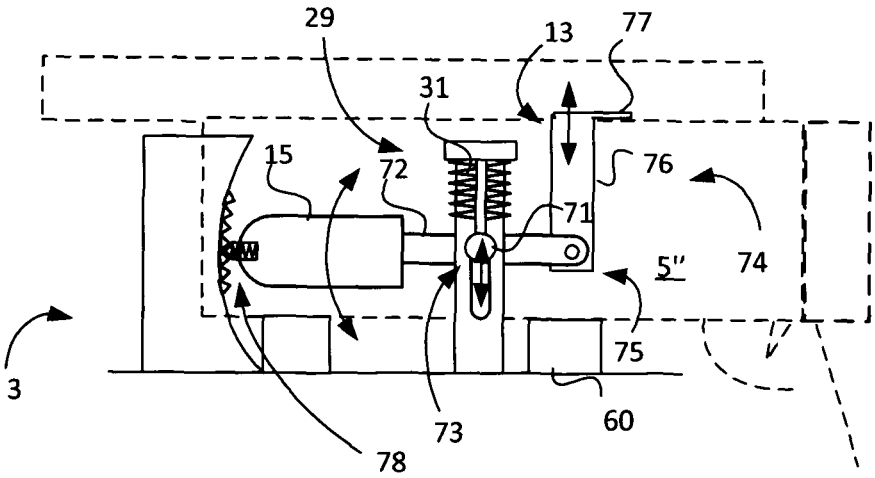
FIG. 10 illustrates one aspect of a locking arrangement comprising a locking device.

FIG. 10 schematically illustrates one aspect of a locking arrangement 3. The arrangement 3 is provided for securing a general firearm 5" to a sub-structure 60. The arrangement 3 comprises a spring mechanism 29 provided for motion (vertically) transverse the sight-of-line of the firearm 5". The spring mechanism 29 exhibits a pivoting axis 71 around which a lever arm 72 middle section 73 is pivoted. At one distal end of the lever arm is mounted a grip handle 15. At the other distal end of the lever arm 72 there is arranged a linkage mechanism 74, which is pivotally mounted in a journal bearing member 75. An actuator arm 76 comprising a hook 77 is mounted to the bearing member 75. The hook 77 is adapted for engagement with the upper side (of fastening portion 13) of the firearm 5". When a user (not shown) turns the grip handle 15 upwardly (orientation as seen in the Figure), the lever arm 72 will rotate about the pivoting axis 71 so that the other distal end will move the actuator arm 76 in a direction downward. If the firearm 5" exhibits a thicker fastening portion 13 than general, the spring mechanism 29 provides that the pivoting axis 71 will be moved upwardly. This will compress a conical compression spring 31 of the spring mechanism 29, still maintaining constant clamping force upon the fastening portion 13.

Thereby the pressure of the hook 77 acting upon the firearm 5" will be the same for all tolerances of the general type of the actual firearm. The handle member 15 is adapted with a locking mechanism 78 arranged for locking the handle member 15 in a locked position for preventing rotational motion of the handle member 15 and eventual accidental unlocking of the handle member 15 is prevented.

Figure 11:
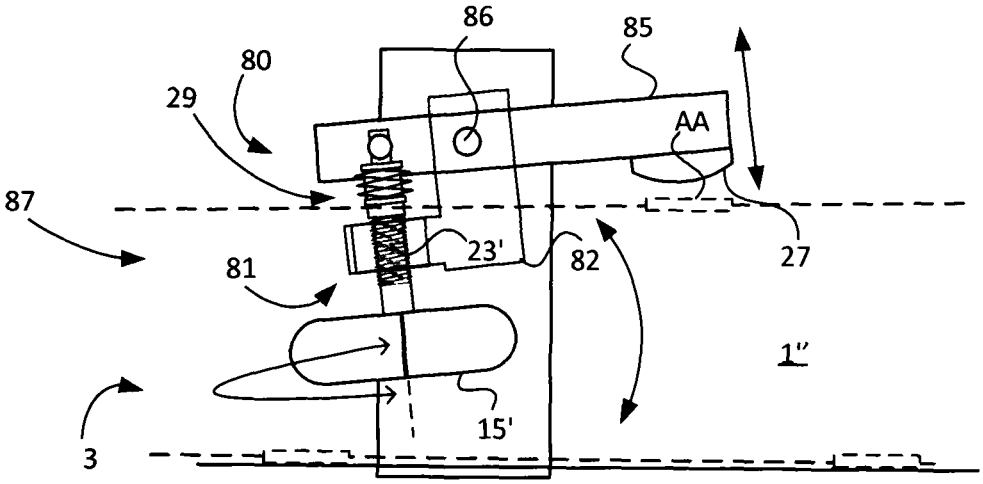
FIG. 11 illustrates a further aspect of the present invention.

FIG. 11 illustrates a further aspect of a locking arrangement 3. The arrangement 3 is adapted for demountable securing a line-of-sight apparatus, such as a machine gun or in this case a TV-camera 1", to the arrangement. The arrangement 3 comprises a locking device 80 for locking the apparatus to the arrangement 3. The locking device 80 comprises a handle member in the form of a wheel 15', being fixed to a rotation mechanism 81. The rotation mechanism 81 comprises a screw 23' extending in rotational engagement through a threaded bore of a rigid portion 82 of the arrangement 3. The screw 23' will due to rotation move a tilt arm 85, which is hinged pivotally around an axis 86 of the rigid portion 82. The rotation mechanism 81 is thus coupled to a translation mechanism 87 comprising the screw 23' moving in rectilinear direction and acting upon the tilt arm 85. The translation mechanism 87 also comprises the tilt arm 85. The tilt arm 85 will in turn clamp upon the TV-camera 1" in proper position despite tolerances. The arrangement is thus adapted for, during maneuver of the locking device 80, converting rotational motion into translator motion. The tilt arm 85 comprises a pressing portion 27, which is provided for abutment against the abutment area AA of the TV-camera 1".

The translation mechanism 87, comprising the screw, also comprises a resilient member 29 provided for urging the pressing portion 27 against the abutment area AA.

The present invention is of course not in any way restricted to the preferred embodiments described above, but many possibilities to modifications, or combinations of the described embodiments, thereof should be apparent to a person with ordinary skill in the art without departing from the basic idea of the invention as defined in the appended claims.

Examples of suitably apparatuses to be mounted to the arrangement are machine guns, sensors, TV-cameras, general machine guns, firearms, small arms and others. Suitably weapon stations for encompassing the arrangement are co-axial weapon stations, remote controlled weapon stations, track fire stations and others. The arrangement material can be cast steel, stainless steel, composite material, aluminum and other materials. There could be two, three or even four locking devices of the type described herein for locking the apparatus in position to the arrangement achieving a pre-determined sight-line. The arrangement may comprise different mechanisms adapted to convert the rotational motion into a rectilinear motion or into a curvilinear motion. The locking device of the arrangement may comprise a combination of the mechanisms adapted to convert the rotational motion into a rectilinear motion and into a curvilinear motion. A front locking device of the arrangement may comprise the mechanism adapted to convert the rotational motion into a rectilinear motion and a rear locking device of the arrangement may comprise the mechanism adapted to convert the rotational motion into a curvilinear motion.

The invention claimed is:

1. A locking arrangement for demountably securing a line-of-sight apparatus, the locking arrangement comprising:

at least on locking device, including:

a translation mechanism;

a rotation mechanism coupled to the translation mechanism adapted for converting rotational motion into translator motion;

a handle member attached to the rotation mechanism to rotate the rotation mechanism;

the translation mechanism including a pressing portion for abutment against an abutment area of the apparatus; a resilient member for urging the pressing portion against the abutment area; a crank member; and a lever mechanism adapted to clamp the arrangement via the abutment area and locking the arrangement to the apparatus, wherein the translation mechanism is adapted to convert rotational motion of the rotation mechanism into a rectilinear motion in a direction corresponding with a longitudinal center line of the apparatus.

2. The arrangement according to claim 1, wherein the resilient member comprises at least one disc spring.

3. The arrangement according to claim 1, wherein a locking mechanism is arranged for locking the handle member in a locked position to prevent a rotating motion.

4. The arrangement according to claim 1, wherein the arrangement comprises two locking devices, including a receiver front locking device and a receiver rear locking device.

5. The arrangement according to claim 4, wherein the front locking device comprises a rectilinear translation mechanism.

6. The arrangement according to claim 4, wherein the rear locking device comprises a curvilinear translation mechanism.

7. The arrangement according to claim 1, wherein the line-of-sight apparatus is a gun.

8. The arrangement according to claim 1, wherein the line-of-sight apparatus is a sensor device.

* * * * *